US005095252A

United States Patent [19]

Kurth

[11] Patent Number: 5,095,252

[45] Date of Patent: Mar. 10, 1992

[54] SYSTEM FOR REMOTE VISUAL INSPECTION EMPLOYING A STROBOSCOPIC LIGHT SOURCE

[75] Inventor: Ingo O. Kurth, Wheatley Heights, N.Y.

[73] Assignee: Olympus Corporation, Lake Success, N.Y.

[21] Appl. No.: 590,365

[22] Filed: Sep. 28, 1990

[51] Int. Cl.[5] ..... H05B 41/36

[52] U.S. Cl. ..... 315/241 S; 315/241 R; 315/200 A; 315/85

[58] Field of Search ..... 315/241 S, 85, 200 A, 315/241 R, 241 P, 209 R, 151, 158

[56] References Cited

U.S. PATENT DOCUMENTS

| | | | |
|---|---|---|---|
| 2,749,482 | 6/1956 | Fruengel | 315/241 |
| 3,543,087 | 11/1970 | Saiger et al. | 315/208 |
| 3,988,635 | 10/1976 | Vincent | 315/241 S |
| 4,084,215 | 4/1978 | Willenbrock | 362/32 |
| 4,117,395 | 9/1978 | Redfield | 324/16 |
| 4,326,804 | 4/1982 | Mossex | 356/375 |
| 4,369,394 | 1/1983 | Vincent | 315/200 |
| 4,572,663 | 2/1986 | Greene et al. | 356/23 |
| 4,742,277 | 5/1988 | Shibuya et al. | 315/176 |
| 4,982,139 | 1/1991 | Amir et al. | 315/151 |

*Primary Examiner*—Eugene R. LaRoche
*Assistant Examiner*—Ali Neyzari
*Attorney, Agent, or Firm*—Kenyon & Kenyon

[57] ABSTRACT

A system employing a stroboscopic light source permits an operator to remotely inspect and analyze high speed repetitive motion of machines. The system enables an operator to freeze motion or permit slow motion in either direction of moving parts in their natural environment. The system effectively shields the electronics incorporated in the light source by separating the electronics into sections and by utilizing a fiber optic cable to carry a control signal which control the firing of the flash lamp of the light source. In addition, the light source provides for control of the phase relationship between an external synchronization signal and a control signal which fires the flash lamp so that the timing of the flash can be controlled to stop a specific event in the cycle.

19 Claims, 5 Drawing Sheets

SYSTEM FOR REMOTE VISUAL INSPECTION EMPLOYING A STROBOSCOPIC LIGHT SOURCE

FIELD OF THE INVENTION

The invention relates to a system for remote visual inspection and, more particularly, a system including a portable stroboscopic light source which permits remote visual inspection of objects in motion.

BACKGROUND OF THE INVENTION

The use of strobe lights to observe objects in motion is well known. The strobe flash enables the human eye to observe action which is occurring at high speed as though the action had stopped or is occurring in slow motion. Perhaps the best known use of the strobe principle is in the adjustment of the timing sequence in an automotive engine in relation to the action of the camshaft.

There are many applications in which it is desirable to observe motion inside an enclosed cavity. Examples of such applications are turbine blades inside a gas turbine engine or valve motion within the cylinders of a reciprocating engine. Such applications require remote visual inspection utilizing a borescope, a flexible fiberscope or a videoscope with a flexible light guide. These instruments use a light guide to transmit light from an external light source through the instrument to illuminate the internal area to be inspected. Such instruments enable an operator to visually inspect internal surfaces of objects which an operator cannot see without disassembling or cutting apart the object.

Prior art systems for remote visual inspection include stroboscopic light sources ("light sources") which have included features such as automatic synchronization of the flash rate of the strobe to the rate of rotation of the object being observed ("target object") and the use of a time delay to delay the firing of the flash to allow an operator to observe the moving object at a fixed time increment after a trigger signal is received. Since the position of the flash in a cycle will change as the speed of the moving object changes, it is imperative that the motion of the object being observed remains constant. Such prior art light sources do not provide an operator access to the flash to adjust the focus of the flash each time the light source requires maintenance.

The prior art light sources have generally been either large units or comprise a number of modules that are not amenable to use in the field. The light sources have been developed to accommodate inspection in a specific location and are not intended to be lightweight and portable.

Interference problems arise when attempting to house a stroboscopic light source including control electronics and a flash unit in a single housing. The interference causes the control electronics to produce false trigger signals to the flash unit thereby causing the flash unit to constantly fire.

The interference that results when attempting to house a light source in a single housing is caused by the large release of energy that occurs each time the flash unit is fired. In a typical prior art stroboscopic light source, a Xenon gas discharge lamp is used to produce a high intensity light pulse of short duration that is needed for stroboscopic illumination. The lamp operates on the principal that Xenon gas is not conducting electricity until it is ionized. Electrical energy is stored in a capacitor connected to the flash lamp to ionize the gas.

Upon receiving a flash trigger signal from the control electronics indicating that the flash lamp should be fired, a high voltage spike (approximately 10,000 volts) ionizes the Xenon gas in the bulb. When the gas in the lamp conducts, the electrical energy stored in the capacitor will rapidly discharge through the Xenon gas thereby causing the lamp to flash.

Based upon typical values of 650 volts and 10 microfarads for the energy storing capacitor, and a flash duration of 2 microseconds, the energy stored in the capacitor is calculated to be 2.1 VAsec (joules) by substituting the foregoing capacitor characteristics into the equation below where E represents energy, V represents voltage and C represents capacitance.

$$E=\tfrac{1}{2}V^2C$$

The power dissipated by the discharging of the capacitor is calculated by the following equation to be one megawatt.

$$\text{Power}=\text{Energy/Time}=2.1\ VAsec/2\ \text{microseconds}=1\ \text{megawatt}$$

Furthermore, the current that travels through the circuit coupled to the capacitor as the capacitor discharges is calculated to be 3,250 amperes.

This large release of energy occurs in pulses. These pulses of rather large magnitude with sharp rise and fall times cause severe electromagnetic interference ("EMI"). As a result, any piece of material, i.e., wires, copper on printed circuit boards, etc., that are in the path of the EMI will act as receiving antennas for the EMI generated. The result is that false signals are generated which cause the associated control electronics to malfunction.

The foregoing problems of prior art light sources manifest the need for improvement. Specifically, there is a need for system employing a stroboscopic light source which houses the flash lamp and the control electronics in the same housing, allows for accurate observation of a specific point on an object being observed and provides an operator with the ability to focus the flash lamp.

SUMMARY OF THE INVENTION

Accordingly, the present invention provides a system for remote visual inspection employing a stroboscopic light source that permits an operator to remotely inspect and analyze high speed repetitive motion of objects in motion. The light source of the system of the present invention enables an operator to freeze motion or permit slow motion in either direction of moving parts in their natural environment. The light source provides for phase control between an external synchronization signal and an internal control signal which fires the flash so that the timing of the flash can be controlled to observe a preselected event in the cycle. In addition, an operator utilizing the light source has the ability to focus the flash to achieve maximum output.

All of the above features are available in one light source. The problem of incorporating all of the above features into one small unit was overcome by effectively shielding the electronics from the effects of the large energy pulse that results when the flash lamp fires. The shielding is accomplished by separating the electronics of the light source into a control electronics section and a high power electronics section and by utilizing a fiber optic cable to carry a control signal which controls the firing of the flash lamp from the control electronics section to the high power electronics section. The use of a fiber optic cable in conjunction with the separation of the control electronics section and the high power electronics effectively shields the control signal from the large energy release that occurs each time the flash fires, thus, preventing false triggering of the flash.

Phase control is a feature of the present invention that accommodates the observation of an event which occurs after a synchronization signal is generated. In automatic synchronization mode, there is one flash produced during each cycle of the object being observed. Normally the timing of the flash occurs each time an external synchronization signal is received. The precise point illuminated each time the external synchronization signal is received may not represent the event to be observed. To allow observation of such events, the present invention provides the ability to vary the relationship between the external synchronization signal and the control signal which controls the firing of the flash in each cycle from 0 degrees to 360 degrees and also provides the ability to continuously adjust the phase relationship between the external synchronization signal and the firing of the flash in each cycle to observe the movement of the target object in slow motion. With phase control, the position of the flash in a cycle will not change with the frequency of the cycle. The angle of the delay of that cycle is constant notwithstanding fluctuations in the frequency. Therefore, the time of the delay changes automatically to maintain a constant phase delay.

Another feature of the present invention provides an operator with the ability to focus the flash lamp to achieve maximum output. The lamp is supported in a lamp module which is removable to allow an operator to replace the lamp. The present invention provides means for adjusting the position of the lamp relative to a light guide support mounted on the front of the light source to focus the pulsed light beam emitted from the light source to provide maximum output.

DETAILED DESCRIPTION

Figure 1:
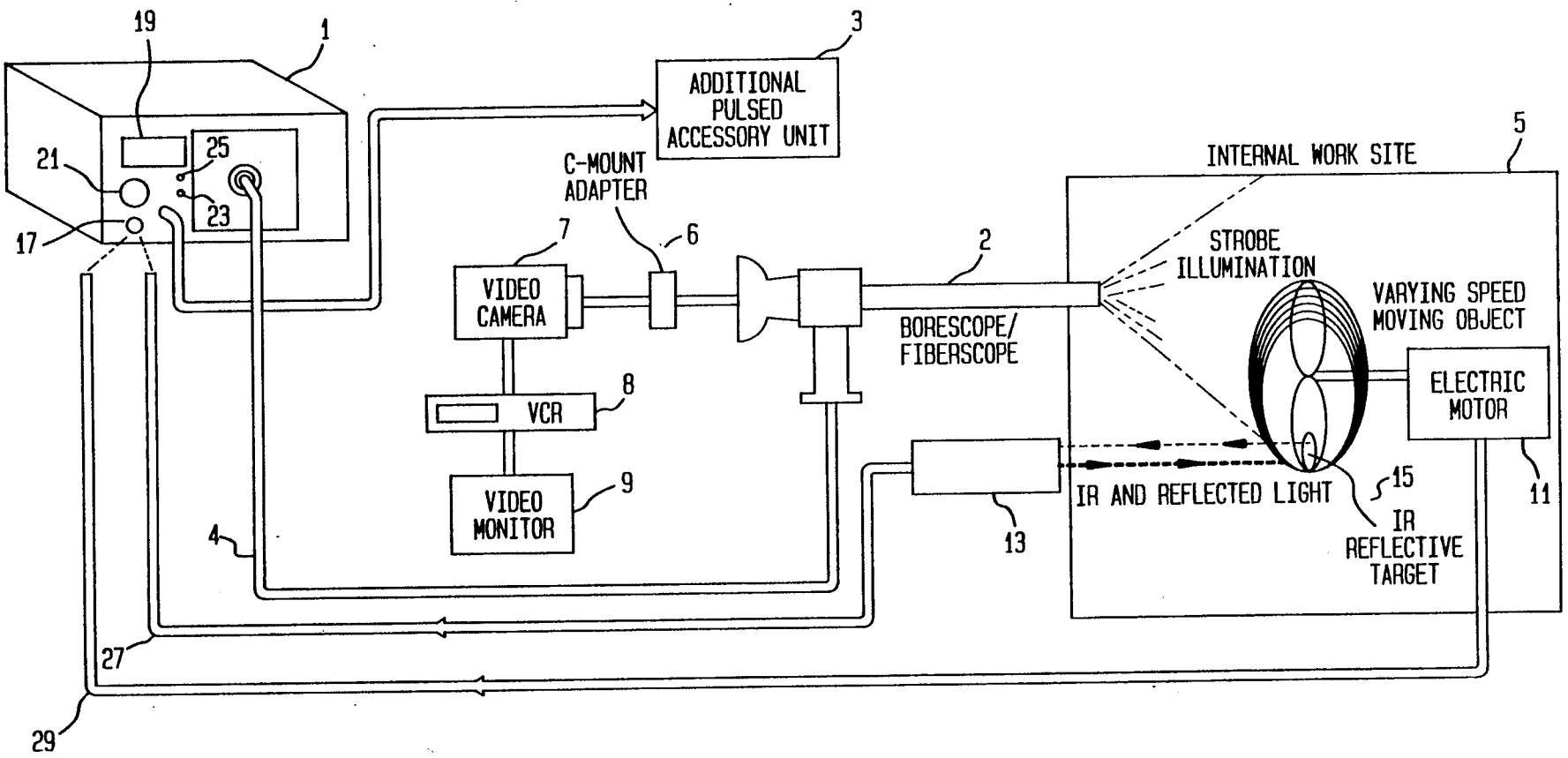
FIG. 1 illustrates a system in accordance with the present invention.

Referring now to the drawings, and initially to FIG. 1, there is illustrated the system of the present invention which is used to observe a target object. The stroboscopic light source ("light source") of the system of the present invention is housed in a light source 1 housing. The light source housing 1 has two outputs and one input. The outputs as shown are coupled respectively to a borescope/fiberscope 2 and an additional pulsed accessory unit 3. The borescope/fiberscope 2 is utilized to carry the light emitted from the light source housing 1 via a fiber optic light guide 4 into a target object 5. The borescope/fiberscope 2 may also be coupled via a C-mount adaptor 6 to a video camera 7, a VCR 8 and a video monitor 9 to enable an operator to record, photograph or observe the target object 5 illuminated by the light source in the light source housing 1. The additional pulsed accessory unit 3 is provided with a "sync out" trigger signal from the light source housing 1 to enable an operator to synchronize the additional pulsed accessory unit 3, which may be, e.g., a camera, to the flash rate of the light emitted from the light source.

The input, referred to as remote input 17, to the light source housing 1 which provides an external synchronization signal to the light source housing 1 can be derived from several possible sources. One source is from an electrical signal, i.e., switch closure, TTL logic, etc., which is generated by, e.g., an electric motor 11, which is driving the target object 5 can be coupled to the remote input 17 via a cable 29. Another possible source is from an infrared probe 13, which can be coupled to the remote input 17 via a cable 27, which employs an infrared source to transmit infrared light to and employs an infrared sensor to receive the light reflected back from the target object 5 through the use of infrared reflective target tape 15.

Mounted to the front of the light source housing is an LCD display 19, a rotating knob 21, and a three position toggle switch "phase control switch" 23 and a two position toggle switch ("display switch") 25. The LCD display 19, knob 21, phase control switch 23 and display switch 25 comprise the operator interface to the light source housing 1. The use of these components is described in detail below.

Through the illustrated configuration, an operator can inspect the target object 5. As will be more fully discussed below, the present invention enables an operator to inspect any event in the cycle of the target object 5 and also to inspect the target object 5 in either forward or reverse slow motion.

Figure 2:
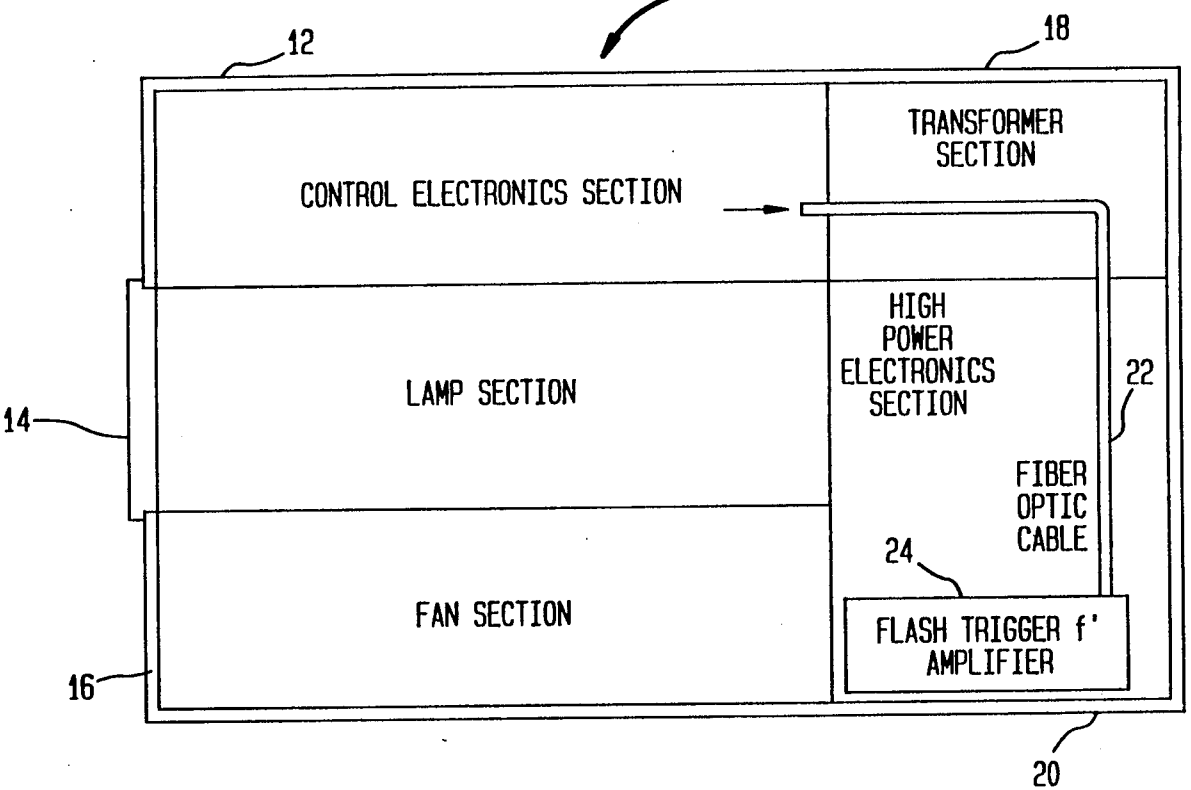
FIG. 2 illustrates the isolation of electronics in a system in accordance with the present invention.

Referring now to FIG. 2, there is illustrated the isolation of the electronics of the light source 10 housed in the light source housing 1 in a system in accordance with the present invention. The isolation is accomplished by partitioning the electronics of the light source 10 into distinct sections and electrically coupling the two sections by a fiber optic cable.

As shown, the electronics of the light source 110 are partitioned into five sections. The sections comprise a control electronics section 12, a flash lamp section 14, a fan section 16, a transformer section 18 and a high power electronics section 20. The control electronics section 12 comprises the electronic circuitry which performs the features that are available for use by an operator in utilizing the system of the present invention to remotely inspect a target object. The flash lamp section 14 comprises a removable flash lamp module which includes a flash lamp (not shown). The lamp module is removable to allow an operator to replace bulbs. Each time the lamp module is removed, the focusing of the flash lamp must be adjusted. This focus feature is discussed below in detail. The fan section 16 houses a fan which provides constant air flow to dissipate heat from the light source. The transformer section 18 is coupled to external AC power. It is through this section that the light source 10 receives its power. The high power electronics section 20 comprises the electronics which are activated by a control signal from the control electronics section 12 that fires the flash lamp housed in the lamp section 14. The control of the lamp will be discussed below in detail.

A control signal referred to as a "flash trigger" signal is transmitted from the control electronics section 12 to the high power electronics section 20 via a fiber optic cable 22 to fire the flash lamp. The fiber optic cable 22 intercouples the control electronics section 12 with the high power electronics section 20. Specifically, the fiber optic cable 22 couples the control electronics section 12 to a flash trigger amplifier 24 in the high power electronics section 20. The flash trigger amplifier 24 generates the proper voltage level to cause the flash lamp to fire. By using the fiber optic cable 22 in conjunction with the partitioning of the electronics of the light source 10, the present invention effectively shields the control electronics section 12 from any and all interference generated each time the flash lamp is fired.

Figure 3:
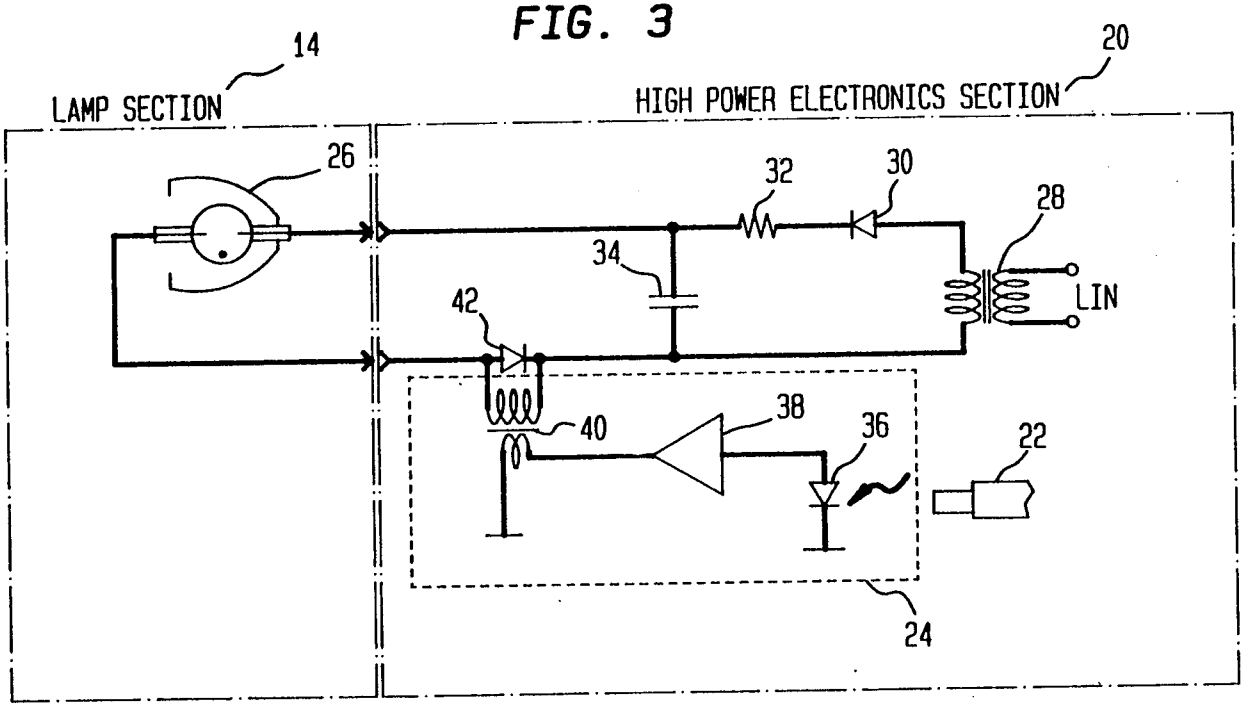
FIG. 3 is a schematic diagram of the high power electronics section of a system in accordance with the present invention.

Reference is now made to FIG. 3 to describe the circuitry of the high power electronics section 20. Specifically, the electrical coupling of the high power electronics section 20 and the lamp section 14 is shown in FIG. 3. The high power electronics section 20 comprises a diode 30, a resistor 32, a capacitor 34 and the flash trigger amplifier 24. A high voltage transformer 28, which is part of the transformer section 18, is also shown. The lamp section 14 comprises a Xenon gas flash bulb 26 which is coupled to the high power electronics section 20.

The transformer 28 is coupled to A.C. line voltage to provide A.C. power to the light source. The diode 30 coupled to the transformer 28 rectifies the A.C. signal output by the transformer 28. The capacitor 34 is charged by the A.C. signal. The resistor 32 completes an R-C network with the capacitor 34.

The trigger coil assembly 24 comprises a photodetector diode 36, an amplifier 38, and a step-up transformer 40. The photodetector diode 36 is optically coupled to the fiber optic cable 22 to receive the flash trigger signal transmitted from the control electronics section 12 (not shown). An input of the amplifier 38 is coupled to the anode of the photodetector diode 36. The amplifier 38 ensures that the flash trigger signal is at the proper voltage level for the step-up transformer 40. The transformer 40 increases the voltage level of the flash trigger signal to the desired level, approximately 10,000 volts, to ionize the Xenon gas in the flash bulb 26 to conduct current. The secondary of the transformer 40 is coupled in parallel to a diode 42. The transformer 40 is polarized such that current cannot flow through the diode 42. The only path for the current to flow is through the flash bulb 26 which will ionize the Xenon gas in the flash bulb 26 and provide a path to discharge the capacitor 34.

When the flash trigger signal is generated by the control electronics section 12, it is received by the photodetector diode 36, amplified by the amplifier 40 and passed as a high voltage pulse from the transformer 40 to the flash bulb 26 to ionize the Xenon gas in the flash bulb 26. When the gas in the flash bulb 26 conducts, the electrical energy stored in the capacitor 34 will rapidly discharge through the Xenon gas thereby causing the flash bulb 26 to flash. The flash duration of the bulb 26 is approximately two microseconds. The resulting power that is dissipated when the flash bulb 26 is fired is approximately one megawatt. Because this high energy pulse is not grounded it will radiate electromagnetic interference ("EMI") throughout the light source housing 1. If ordinary wire were used to carry the flash trigger signal from the control electronics section 12 to the high power electronics section 20, the EMI would induce false trigger signals on the wire causing the flash lamp to intermittently or continuously fire.

The potential of these false trigger signals occurring is overcome by using the fiber optic cable 22 to transmit the flash trigger signal from the control electronics section 12 to the high power electronics section 20. The properties of the fiber optic cable 22 in conjunction with the partitioning of the electronics of the light source 10 into sections effectively isolates the control electronics section 12 from the high power electronics section 20 and eliminates any potential interference problems. The cable 22 is not susceptible to the type of interference radiated when the large energy pulse is released by the transformer 40.

Figure 4:
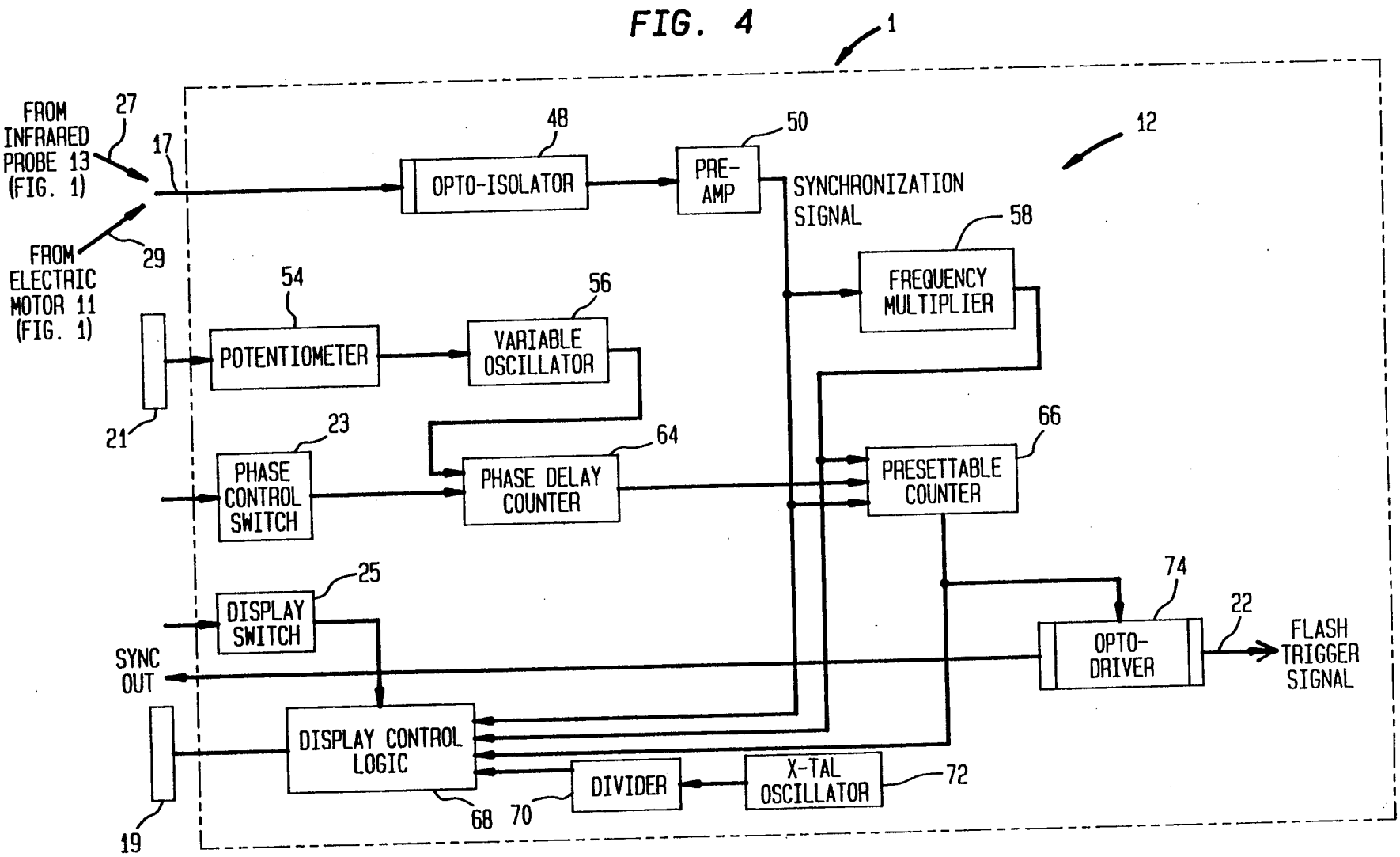
FIG. 4 is a block diagram of the control electronics section of a system in accordance with the present invention.

Referring now to FIG. 4, there is illustrated in block diagram form, an exemplary embodiment of the electronic circuitry of the control electronics section 12 in accordance with the system of the present invention. Also shown are the connections of the circuitry to the operator interface discussed in conjunction with FIG. 1.

The circuitry of the control electronics section 12 comprises an opto-isolator 48, a pre-amplifier 50, a frequency multiplier 58, a variable oscillator 56, a phase delay counter 64, a potentiometer 54, a presettable counter 66, a crystal ("X-tal") oscillator 72, a divider 70, display control logic 68 and an opto-driver 74. The control electronics section 12 is coupled to the high power electronics section 20 by the fiber optic cable 22.

As discussed above, there are several sources of input that may provide a synchronization signal which is used by the control electronics section 12. These input sources are discussed further below. Regardless of which type of input source provides a synchronization signal, the input is coupled via the remote input 17 to an input of the opto-isolator 48. The opto-isolator 48 is coupled to the pre-amplifier 50. The pre-amplifier 50 provides signal conditioning for the synchronization signal received from the input source. The output of the pre-amplifier 50 as shown in FIG. 4 is labeled "synchronization signal". The output of the pre-amplifier 50 is coupled to an input of the frequency multiplier 58, the presettable counter 66 and the display control logic 68. The output of the frequency multiplier 58 is coupled to the clock input of the presettable counter 66 and the display control logic 68. The frequency multiplier 58 generates a plurality of pulses each time a synchronization signal is received.

As discussed above, an operator has access to the features of the present invention by utilizing the LCD display 19, the rotating knob 21, the phase control switch 23 and the display switch 25. The rotating knob 21 is coupled to the potentiometer 54. As discussed above, the potentiometer 54 is coupled to the variable oscillator 56. An operator can control the speed of the variable oscillator 56 through rotating knob 21 which, in turn, controls the potentiometer 54 as will be discussed below. The LCD display 19 is coupled to the display control logic 68. The phase-control switch 23 is a three-pole, three-throw switch which has outputs coupled to the phase delay counter 64. The phase delay switch 23 has increase, hold and decrease settings. The phase delay 64 counter is an up/down counter. The switch setting of the phase control switch 6 controls the direction of the count of the phase delay counter 64.

The display switch 25 has an output coupled to the display control logic 68. The display switch 25 has a flashes per minute setting and a phase delay setting.

An output of the variable oscillator 56 is coupled to the clock input of the phase delay counter 64. Outputs of the phase delay counter 64 are coupled to inputs of the presettable counter 66. The presettable counter 66 is also an up/down counter. When the output of the presettable counter 66 goes to zero, the output coupled to the opto-driver 74 will carry the flash trigger signal. Outputs of the presettable counter 66 are also coupled to the display control logic 68.

The opto-driver 74, which has an input coupled to the presettable counter 66, has an output which is coupled to the fiber optic cable 22 which carries the flash trigger signal to the high power electronics section 20. An output of the opto-driver 74 is also routed to the user interface to provide a "sync out" signal to the additional pulsed accessory unit 3 shown in FIG. 1. This signal can be used to synchronize accessories to the flash rate of the flash as was described above.

The display control logic 68 comprises logic to control the LCD display 19 which provides readings to an operator. The source of the readings displayed on the LCD display 19 can either be from the frequency multiplier 58 or from the crystal oscillator 72 via the divider 70. The source is selected by an operator via display switch 25.

In automatic synchronization mode, i.e., where the light source is automatically synchronized to motion of the target object, the rate of the flash is synchronized by a synchronization signal generated by one of several possible input sources as discussed above. The synchronization signal is coupled to the light source housing 1 through the remote input 17 (as shown in FIG. 1) and is received by the opto-isolator 48. The source of the synchronization signal is either an electrical or optical device.

The use of infrared light for automatic synchronization depends on reflected infrared light from the target object. The infrared probe 13 shown in FIG. 1 coupled to the opto-isolator 48 employs both an infrared source and an infrared sensor. The infrared source of the infrared probe 13 emits an infrared pulse of light to a reflector on the target object. The light reflected back to the infrared sensor of the infrared probe 13 causes the infrared probe 13 to generate a synchronization signal that is transmitted to the light source housing 1 via cable 27. The reflector utilized is a highly reflective adhesive infrared tape, e.g., 3M Photoelectric Scanning Tape, Type 7900, which is affixed to a desired point on the target object. This tape reflects the infrared light back to the infrared sensor of infrared probe 13. The reflective tape is attached to some part of the target object to be viewed. The tape does not have to be affixed to the part of the object being observed. It can be placed on any area or part which moves at the same speed or at a speed directly related to the speed of the part being observed.

Alternately, the light source can be automatically synchronized to the motion of a target object by an electrical synchronization signal available from the target object. The electrical synchronization signal must have some direct relation to the speed of rotation of the target object, e.g., an output of an electrical motor driving the object. This electrical synchronization signal is coupled to the control electronics section 12 via cable 29 to the remote input 17.

The synchronization signal provided is passed through the pre-amplifier 50 when it is received by the control electronics section 12. Pre-amplifier 50 provides the proper amplification of the received signal to drive the remaining circuitry. The synchronization signal is passed to the frequency multiplier 58 where it is used to synchronize the frequency of the frequency multiplier 58 to the rate of rotation of the object being observed. The frequency multiplier 58 utilized in the exemplary embodiment is a phase locked loop circuit. Each output pulse of the frequency multiplier 58 is arranged to represent one-half of one degree of one cycle of rotation of the target object, regardless of the actual frequency of the target object. Such arrangement facilitates the features of phase control and slow motion where a resolution of one-half of one degree is desired as is explained below.

Pursuant to a feature of the present invention, an operator may introduce phase control to allow observation of a particular event during the revolution or cycle of the target object. In automatic synchronization mode, one flash is produced per revolution or cycle of the target object. Without phase control, the timing of that flash is at the instant when the infrared target cuts the infrared beam and reflects its light to the infrared probe 13 or when the electrical synchronization signal is generated. This, however, may not be at the instant of an event that an operator wishes to observe. For example, an operator may wish to capture the position of a cam and a valve at the peak of their rise during the cam's rotation. To do this the flash must be delayed until this point in the cycle is reached. This is what the phase control feature of the system of the present invention accomplishes. The relationship between the synchronization signal and the actual flash can be varied in each cycle, from 0 degrees (when the target cuts the beam or when the electrical synchronization signal is generated) to 360 degrees (when the target cuts the beam again for the next cycle or when the next electrical synchronization signal is generated). Thus, the present invention provides the ability to control the timing of the flash to stop the target object's motion at any point in the cycle. The motion can be linear as well as circular. The angle of delay or phase angle is measured in degrees from 0° to 360° and can be displayed by the display control logic 68 on the LCD display 19 by setting the display switch 25 to its phase angle setting.

By adjusting the phase delay, an operator can vary the relationship between the synchronization signal and the actual flash from zero degrees through 360 degrees. To adjust the phase delay between the synchronization signal and the flash trigger signal that triggers the flash bulb 26 (shown in FIG. 3), the phase delay counter 64 and phase control switch 23 are utilized in conjunction with the variable oscillator 56 to either increase, decrease or hold the count in the phase delay counter 64.

The synchronization signal is received by the control electronics section 12 once for every cycle of the target object's revolution. The synchronization signal is passed via the opto-isolator 48 to the frequency multiplier 58, the presettable counter 66 and the display and control logic 68. Upon receiving the synchronization signal, the frequency multiplier 58 multiplies the synchronization signal by 720 to generate 720 output pulses at a frequency 720 times that of the synchronization signal so as to provide a resolution of one-half of one degree for one cycle of rotation of the target object. The rotation of the target object can be represented in degrees. The frequency multiplier 58 represents the cycle of rotation of the target object in half degrees increments. By providing this arrangement, an operator may obtain a phase delay resolution of one-half of one degree as is explained below.

The output of the frequency multiplier 58 is also coupled to the display control logic 68. The display control logic 68 utilizes the signals from the frequency multiplier 58 to display on the LCD display 19 the phase delay between the synchronization signal and the generation of the flash trigger signal in degrees to an operator.

Before or after the synchronization signal is received by the control electronics section 12, a user will specify via the phase control switch 62 coupled to the input of the phase delay counter 64 whether the phase delay feature is desired. By controlling the setting of the phase control switch 62, an operator may adjust the phase delay (by setting the switch 62 to the increase or decrease setting) and can lock the phase delay (by changing the setting of the switch 62 to the hold setting) at a desired phase angle to permit the operator to observe a specific point on the target object. Thus, by controlling the speed of the oscillator 56 via the rotating knob 21 which, in turn, controls the potentiometer 54, and setting the phase control switch 62 to the desired setting, the operator has configured the control electronics section 12 to implement the phase control feature upon receiving the synchronization signal.

Upon receiving the synchronization signal, the frequency multiplier 58 begins its cycle of generating 720 output pulses. Also, when the synchronization signal is received at an input of the presettable counter 66, the output of the phase delay counter 64, which is controlled by the phase control switch 62 and the variable oscillator 56, is loaded into the presettable counter 66. The presettable counter 66 is configured to count down upon being loaded under the control of the frequency multiplier 58. The output pulses of the frequency multiplier 58 clock the presettable counter 66 causing the counter 66 to count down. Thus, for each pulse output by the frequency multiplier 58, the presettable counter 66 will decrement from the count loaded upon receiving the synchronization signal from the phase delay counter 64, until its output reaches zero. When the output of the presettable counter 66 reaches zero, the flash trigger signal is generated. The flash trigger signal activates the opto-driver 74 which, in turn, drives the flash trigger signal across the fiber optic cable 22 to the high power electronics section 20 (shown in FIG. 2). Upon receiving this signal, the flash bulb 26 (shown in FIG. 3) fires.

An operator can control the amount of phase delay by controlling the position of the phase control switch 62 and the speed of the variable oscillator 56. By placing the phase control switch 62 in either the increase or the decrease position, the operator can control the size of the increase or decrease in the phase angle. The phase control switch 62 is coupled to the up/down input of the phase delay counter 64 thereby controlling the direction in which the phase delay counter 64 counts. The phase delay counter 64 counts up to 720 and then is reset to start again at zero or counts down from 720 to zero and then starts up again and starts counting down again. The count for the phase delay counter 64 is set by adjusting the variable oscillator 56 and monitoring the LCD display 19 controlled by the display control logic 68. Thus, when the desired phase delay is reached, an operator can freeze the phase delay at the desired angle by simply adjusting the position of the phase control switch 62 from either the increase or the decrease position to the hold position thereby freezing the phase delay regardless of any speed changes in the target object.

The phase control feature allows a user to observe specific points on the target object which may not necessarily be in view when the synchronization signal is generated, received and acted upon by the control electronics section 12.

Another feature of the present invention is to provide an operator with the ability to observe a target object in slow motion. This feature is achieved by increasing or decreasing the count in the phase delay counter 64 as discussed above. This is achieved by setting the phase control switch 62 in either the increase or decrease position and adjusting the speed of the variable oscillator 56 by adjusting the position of the rotating knob 21. Each time a synchronization signal is received by the strobe, the count stored in the phase delay counter 64 is loaded into the presettable counter 66. The count of the presettable counter 66 will increase or decrease (depending on the position of the phase control switch 62) steadily with the speed of the variable oscillator 56. As a result, the phase delay between the synchronization signal and the flash trigger signal will steadily increase or decrease at the speed at which the variable oscillator 56 is set. The resulting visual effect is that the object moves at the speed of the variable oscillator 56 independent of true speed because of the phase control feature of the present invention.

To increase the phase delay, the variable oscillator 56 is allowed to step up the count of the phase delay counter 64. The larger the number, the longer the wait until the count goes to zero. When the phase delay counter 64 reaches a count of 720, it is reset and starts counting up from zero. To decrease the phase delay, the variable oscillator 56 is allowed to step down the count of the phase delay counter 64. Thus, when the phase delay counter 64 reaches zero, the phase delay counter 64 is reset to a count of 720 and continues to count down from there.

The display control logic 68 in conjunction with the display switch 25 controls the LCD display 19 which displays such information to an operator as the number of flashes per minute or the phase delay. If the display switch 25 is set to its phase delay setting, the LCD display 19 displays the number of output pulses from the frequency multiplier 58 between the synchronization signal and the flash trigger signal divided by two. This number is equivalent to the phase angle in degrees between these two signals. If the display switch 25 is set to its flashes per minute setting, the LCD display is controlled by the X-tal oscillator 72 through the divider 70 to display the number of pulses from the frequency multiplier 58 between two crystal controlled timing pulses.

Figure 5:
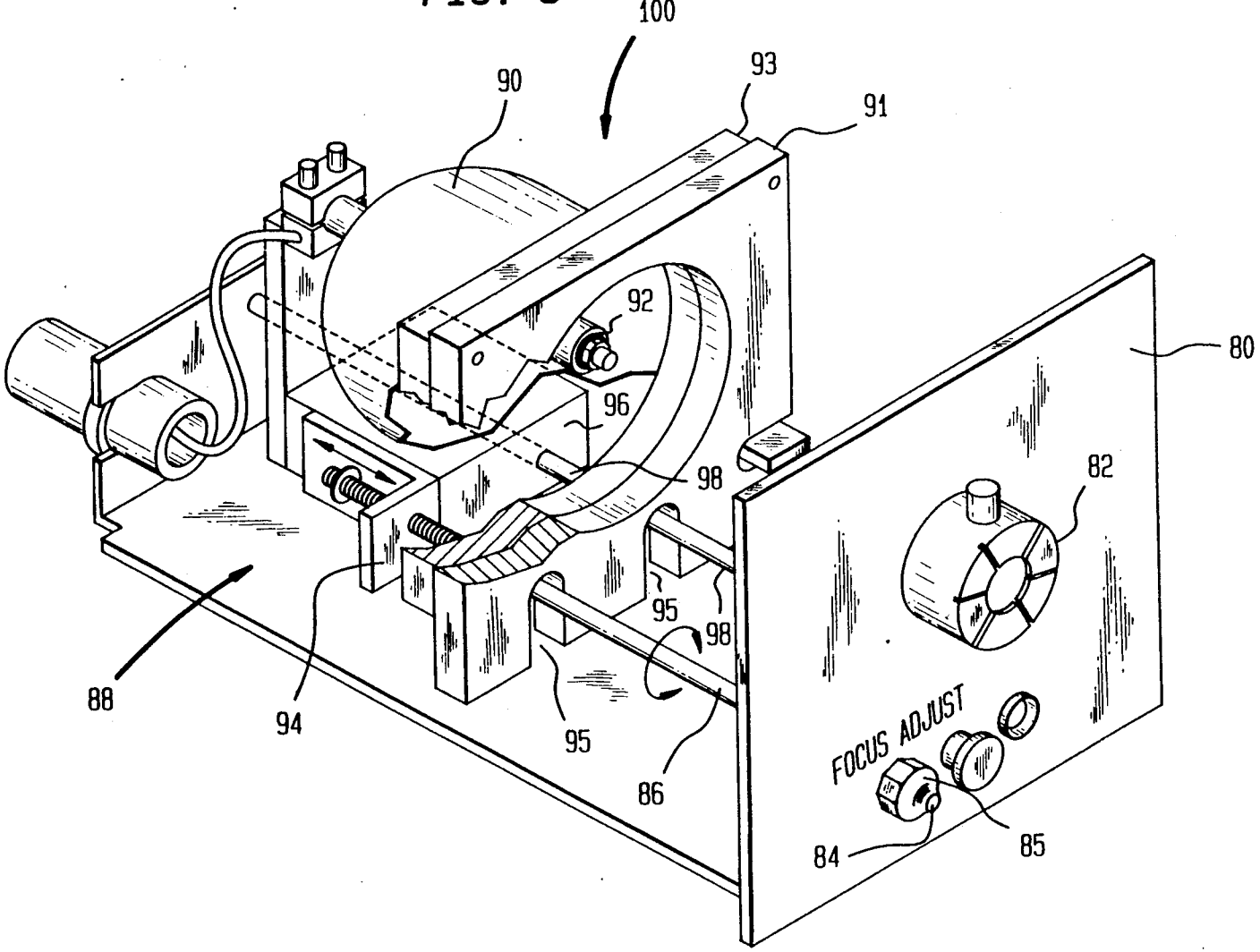
FIG. 5 is a perspective view of the lens control mechanism of a system in accordance with the present invention.

Another feature of the present invention is the ability to adjust the flash lamp in order to focus a pulsed light beam emitted from the light source housing 1 to provide for maximum output. Each time the lamp module is removed, the lamp must be refocused to ensure maximum output from the light source. In FIG. 5, a cut away view of the light source of the system of the present invention is shown as indicated generally by reference numeral 100. The light source 100 includes a faceplate 80 which has a light guide receptacle 82 supported on the front face thereof. The receptacle 82 provides an input for coupling a light guide (not shown) to the unit, such as a conventional 12 mm BLR-16 light guide. A screw 84 is also supported on the front face of the faceplate 80 by a hexagonal member 85. The screw 84 extends through the faceplate 80 and is coupled to a focus adjustment shaft 86. The other end of the shaft 86 is threaded and, in turn, coupled to a bracket 94 of a lamp module 88. The lamp module 88 further comprises a reflector 90, a front face plate 91, a rear face plate 93, a block 96 and a flash lamp 92. The front face plate 91 has two U-shaped apertures 95 extending through the bottom edge thereof and each is adapted to receive the shafts 86 and 98, respectively therethrough.

The light source 100 is focused by rotating the screw 84 which, in turn, rotates the shaft 86, as indicated by the arrows in FIG. 5. The rotation of the shaft 86 in turn drives the lamp module 88 in the axial direction of the shaft, as also indicated by the arrows in FIG. 5. By rotating the shaft 86 via the screw 84, the threaded end of the shaft 86 causes the bracket 94 to move in the indicated axial direction. The bracket 94 is rigidly mounted to the block 96 which, in turn, can slide back and forth on a second shaft 98. The lamp 92 is coupled to the block 96. Thus, by rotating the focus adjustment shaft 86, the lamp 92 moves axially in the indicated direction to align the lamp for maximum output.

The above-described embodiment of the invention is meant to be representative only, as certain changes may be made therein without departing from the clear teachings of the invention. Accordingly, reference should be made to the following claims which alone define the invention.

What is claimed is:

1. A stroboscopic light source comprising:

a housing divided into a plurality of compartments;

a high power electronics section in a first one of the plurality of compartments, the high power electronics section comprising a flash lamp module which includes a gas filled flash bulb, means for supplying power to the stroboscopic light source, means for receiving a control signal, means for ionizing the gas in the flash bulb in response to receiving the control signal, and means for storing the power supplied to the stroboscopic light source coupled to the means for supplying power, said means for storing including means for discharging said power stored therein in response to said means for ionizing the gas in the flash bulb thereby illuminating the flash bulb;

a control electronics section in a second one of the plurality of compartments, the control electronics section comprising means for receiving a remote synchronization signal and means for controlling the flash lamp module in the high power electronics section by generating the control signal in response to the remote synchronization signal, the control electronics section being physically isolated from the high power electronics section by being in a separate compartment; and a fiber optic cable coupling the control electronics section to the high power electronics section to provide a transmission path to transmit the control signal from the control electronics section to the high power electronics section, the fiber optic cable electrically isolates the control electronics section from the high power electronics section.

2. The stroboscopic light source according to claim 1 wherein the flash lamp module comprises a gas filled flash bulb and the high power electronics further comprises:

a power supply;

a first transformer coupled to the power supply;

a capacitor coupled to the first transformer, said capacitor being charged by the power delivered from said power supply; and a flash trigger amplifier coupled to the fiber optic cable for receiving the control signal from the control electronics, the flash trigger amplifier comprising a trigger coil assembly coupled to said capacitor and said flash bulb, said trigger assembly ionizing the gas in the flash bulb in response to the control signal so that said capacitor discharges said power stored in said capacitor thereby illuminating the flash bulb.

3. A stroboscopic light source for permitting remote visual inspection of a target object in motion, the stroboscopic light source comprising:

a high power electronics section comprising a flash lamp module for generating pulses of light;

a fiber optic cable;

a control electronics section coupled to the high power electronics section by the fiber optic cable, the control electronics section comprising:

a remote input adapted to receive a synchronization signal which is related to the motion of the target object;

a frequency multiplier having an input and an output, the input coupled to the remote input, the frequency multiplier generates a predetermined number of pulses at the output in response to the synchronization signal, the predetermined number of pulses being related to the synchronization signal;

a first device having an input coupled to the output of the frequency multiplier, the first device including:

means for generating a control signal after a preselected amount of time has elapsed under the control of the output of the frequency multiplier, and means for transmitting the control signal via the fiber optic cable to the high power electronics section;

the high power electronics section further comprising means for triggering the flash lamp causing the flash lamp to emit a light pulse in response to the control signal.

4. The stroboscopic light source according to claim 3 wherein the stroboscopic light source is contained in a single housing.

5. The stroboscopic light source according to claim 3 wherein the control electronics section further comprises a second device coupled to inputs of the first device, the second device initializes the first device under the control of the synchronization signal to pause the preselected amount of time before generating the control signal.

6. The stroboscopic light source according to claim 5 wherein the second device comprises an up/down counter and wherein the control electronics section further comprises a switch coupled to an input of the second device for controlling the direction of the count of the counter.

7. The stroboscopic light source according to claim 6 wherein the control electronics section further comprises an oscillator coupled to a clock input of the second device to control the preselected amount of time that is transferred to the first device.

8. The stroboscopic light source according to claim 7 wherein the control electronics section further comprises a potentiometer coupled to the oscillator to control the frequency of the oscillator.

9. A method for controlling the phase relationship between a remote synchronization signal and a control signal generated in response to the remote synchronization signal in a stroboscopic light source, comprising the steps of:

(a) setting a potentiometer to control the speed of a variable oscillator;

(b) setting a switch to indicate whether a positive or negative phase relationship is desired between the remote synchronization signal and the control signal;

(c) receiving the remote synchronization signal;

(d) generating a predetermined number of pulses in response to the remote synchronization signal;

(e) delaying the generation of the control signal for a preselected amount of time controlled by the speed of the variable oscillator and the setting of the switch; and (f) generating the control signal after the preselected amount of time has elapsed.

10. The method according to claim 9 wherein the stroboscopic light source includes a gas filled flash bulb, further comprising the steps of:

(a) storing power in a capacitor coupled to a power supply and the flash bulb;

(b) transmitting the control signal via a fiber optic cable;

(c) generating a pulse to ionize the gas in the gas filled flashed bulb in response to the control signal; and (d) discharging the capacitor when the gas in the gas filled flash bulb is ionized causing the flash bulb to fire thereby illuminating the flash bulb.

11. A system for remote visual inspection of a target object in motion comprising:

a stroboscopic light source in a single housing, the housing being divided into a plurality of compartments, the stroboscopic light source comprising:

a remote input for receiving a synchronization signal, a high power electronics section in a first one of the plurality of compartments, the high power electronics section comprising a flash lamp module which includes a gas filled flash bulb, means for supplying power to the stroboscopic light source, means for receiving a control signal, means for ionizing the gas in the flash bulb in response to receiving the control signal, and means for storing the power supplied to the stroboscopic light source coupled to the means for supplying power, said means for storing including means for discharging said power stored therein in response to said means for ionizing the gas in the flash bulb thereby illuminating the flash bulb, a control electronics section in a second one of the plurality of compartments, the control electronics section comprising means for receiving a remote synchronization signal and means for controlling the flash lamp module in the high power electronics section by generating the control signal in response to the remote synchronization signal, the control electronics section being physically isolated from the high power electronics section by being in a separate compartment, a fiber optic cable coupling the control electronics section to the high power electronics section to provide a transmission path to transmit the control signal from the control electronics section to the high power electronics section, the fiber optical cable electrically isolates the control electronics section from the high power electronics section, and a light guide support adapted to support a light guide thereon, the support being located relative to the flash lamp module so that a light guide supported thereon can receive a pulsed light beam from the flash lamp module;

a light guide coupled to the light guide support;

a borescope/fiberscope coupled to the light guide being arranged to illuminate an area of the target object to be remotely inspected; and means for generating the synchronization signal coupled to the remote input.

12. The system for remote visual inspection of a target object in motion according to claim 11 wherein a reflective target is affixed to an area on the target object and wherein the means for generating the synchronization signal comprises an infrared probe, the infrared probe including:

an infrared source for generating infrared light;

an infrared sensor for receiving infrared light reflected back from the reflective target affixed to the target object; and a signal generator for generating the synchronization signal when the infrared sensor receives the infrared light reflected back from the target object.

13. The system for remote visual inspection of a target object in motion according to claim 11 wherein the means for generating the synchronization signal comprises an electric motor which controls the motion of the target object.

14. The system for remote visual inspection of a target object in motion according to claim 11 wherein the control electronics section further comprises:

a frequency multiplier having an input and an output, the input coupled to the remote input, the frequency multiplier generates a predetermined number of pulses at the output of the frequency multiplier in response to the synchronization signal, the predetermined number of pulses being related to the synchronization signal;

a first device having an input coupled to the output of the frequency multiplier, the first device including:

means for generating a control signal after a preselected amount of time has elapsed under the control of the output of the frequency multiplier, and means for transmitting the control signal via the fiber optic cable to the high power electronics section;

the high power electronics section further comprising means for triggering the flash lamp causing the flash lamp to emit a light pulse in response to the control signal.

15. The system for remote visual inspection of a target object in motion according to claim 14 wherein the control electronics section further comprises a second device coupled to inputs of the first device, the second device initializes the first device under the control of the synchronization signal to pause the preselected amount of time before generating the control signal.

16. The system for remote visual inspection of a target object in motion according to claim 15 wherein the second device comprises an up/down counter and the control electronics section further comprises a switch coupled to an input of the second device for controlling the direction of the count of the counter.

17. The system for remote visual inspection of a target object in motion according to claim 15 wherein the control electronics section further comprises an oscillator coupled to a clock input of the second device to control the preselected amount of time that is transferred to the first device.

18. The system for remote visual inspection of a target object in motion according to claim 17 wherein the control electronics section further comprises a potentiometer coupled to the oscillator to control the frequency of the oscillator.

19. The system for remote visual inspection of a target object in motion according to claim 14 wherein the stroboscopic light source further includes an output coupled to the means for generating a control signal, the output being coupled by a cable to an additional pulsed accessory unit.

* * * * *